US008072390B2

(12) United States Patent
Breiter

(10) Patent No.: US 8,072,390 B2
(45) Date of Patent: Dec. 6, 2011

(54) ANTENNA ARRANGEMENT

(75) Inventor: Richard Breiter, Frederiksberg (DK)

(73) Assignee: Nokia Corporation, Espoo (FI)

( * ) Notice: Subject to any disclaimer, the term of this patent is extended or adjusted under 35 U.S.C. 154(b) by 470 days.

(21) Appl. No.: 12/224,231

(22) PCT Filed: Feb. 22, 2006

(86) PCT No.: PCT/IB2006/001078

§ 371 (c)(1),
(2), (4) Date: Oct. 23, 2008

(87) PCT Pub. No.: WO2007/096693

PCT Pub. Date: Aug. 30, 2007

(65) Prior Publication Data

US 2009/0167627 A1 Jul. 2, 2009

(51) Int. Cl.
*H01Q 1/50* (2006.01)

(52) U.S. Cl. ..... 343/852; 343/876; 343/702; 343/893

(58) Field of Classification Search ..... 343/700 MS, 343/852, 729, 725, 771, 722, 768, 802, 778, 343/872, 749, 753, 719, 713, 703, 846, 702, 343/727, 730, 742, 795, 829, 770, 895, 844, 343/708, 715, 792.5, 754, 853, 876, 893
See application file for complete search history.

(56) References Cited

U.S. PATENT DOCUMENTS

| | | | | |
|---|---|---|---|---|
| 5,659,889 | A | 8/1997 | Cockson | |
| 6,650,295 | B2 | 11/2003 | Ollikainen et al. | |
| 6,891,506 | B2 | 5/2005 | Jarmuszewski et al. | |
| 2004/0075613 | A1 | 4/2004 | Jarmuszewski et al. | |
| 2004/0233109 | A1 | 11/2004 | Ying et al. | |
| 2006/0132360 | A1 * | 6/2006 | Caimi et al. | 343/700 MS |
| 2007/0139280 | A1 * | 6/2007 | Vance | 343/702 |

FOREIGN PATENT DOCUMENTS

| | | |
|---|---|---|
| EP | 1109251 | 6/2001 |
| EP | 1396906 | 3/2004 |
| EP | 1469549 | 10/2004 |
| GB | 2326799 | 12/1998 |
| WO | WO 2004/047220 | 6/2004 |

OTHER PUBLICATIONS

Database WPI, Week 200518; Derwent Publications Ltd., London, GB; AN 2005-165220 and CN1551658 A (LG Electronics China Res. & Dev Cent Co L); Dec. 1, 2004; Abstract.

* cited by examiner

*Primary Examiner* — Dieu H Duong
(74) *Attorney, Agent, or Firm* — Alfred A. Fressola; Ware, Fressola, Van der Sluys & Adolphson LLP

(57) ABSTRACT

An antenna arrangement comprises a first antenna element; a second antenna element; a coupling element for electromagnetically coupling to the first antenna element and the second antenna element; and a switching mechanism, connected to the coupling element, for switching between a first electrical configuration and a second electrical configuration. When the switching mechanism is in the first electrical configuration, the coupling element has a first impedance and when the switching mechanism is in the second electrical configuration, the coupling element has a second impedance.

16 Claims, 7 Drawing Sheets

ANTENNA ARRANGEMENT

CROSS REFERENCE TO RELATED APPLICATIONS

This application is the U.S. National Stage of International Application Number PCT/IB2006/001078 filed on Feb. 22, 2006 which was published in English on Aug. 30, 2007 under International Publication Number WO 2007/096693.

FIELD OF THE INVENTION

Embodiments of the present invention relate to an antenna arrangement. In particular, they relate to an antenna arrangement for a radio transceiver device.

BACKGROUND TO THE INVENTION

In recent years, it has become desirable for radio transceiver devices, such as cellular telephones, to be able to communicate over multiple bands of the radio portion of the electromagnetic spectrum. This has arisen because different countries tend to use different frequency bands for cellular networks. For example, US WCDMA is at 850 MHz whereas EU WCDMA is at 2100 MHz. Even in a single country, different services may be provided at different radio frequency bands, for example, PCS is at 1900 MHz whereas PCN is at 1800 MHz. Consequently, cellular telephones require multi-band antenna arrangements that can allow them to communicate over multiple bands of the radio portion of the electromagnetic spectrum.

Increasingly, multi-band antenna arrangements are using more than one antenna element to transmit and receive electromagnetic waves. Currently, each 'active' antenna element within such an antenna arrangement requires its own tuning circuit so that it may operate in a desired set of operational frequency bands. However, each tuning circuit requires space within the radio transceiver device and has a fiscal cost associated with it. Consequently, multi-band antenna arrangements are becoming increasingly large and expensive.

It would therefore be desirable to provide an alternative antenna arrangement.

BRIEF DESCRIPTION OF THE INVENTION

According to one embodiment of the invention there is provided an antenna arrangement comprising: a first antenna element; a second antenna element; a coupling element for electromagnetically coupling to the first antenna element and the second antenna element; and a switching mechanism, connected to the coupling element, for switching between a first electrical configuration and a second electrical configuration, wherein when the switching mechanism is in the first electrical configuration, the coupling element has a first impedance and when the switching mechanism is in the second electrical configuration, the coupling element has a second impedance.

When the switching mechanism is in the first electrical configuration, the first antenna element may operate in a first operational frequency band and the second antenna element may operate in a second operational frequency band.

When the switching mechanism is in the second electrical configuration, the first antenna element may operate in a third operational frequency band and the second antenna element may operate in a fourth operational frequency band.

The switching mechanism may comprise a first impedance matching circuit, a second impedance matching circuit and a switch. The switch may be for connecting the coupling element to the first impedance matching circuit or the second impedance matching circuit.

The switching mechanism may be in the first electrical configuration when the switch connects the first impedance matching circuit to the coupling element.

The switching mechanism may be in the second electrical configuration when the switch connects the second impedance matching circuit to the coupling element.

The coupling element may comprise a first portion and a second portion. The first portion may be arranged to electromagnetically couple with the first antenna element. The second portion may be arranged to electromagnetically couple with the second antenna element.

The antenna arrangement may comprise a plurality of antenna elements. The coupling element may be arranged to electromagnetically couple to each of the plurality of antennas.

When the switching mechanism is in the first electrical configuration, the plurality of antenna elements may operate in a first set of operational frequency bands.

When the switching mechanism is in the second electrical configuration, the plurality of antenna elements may operate in a second set of operational frequency bands.

Each antenna element may be connected to a feed via a feed point. Each antenna element may be connected to a ground plane via a ground point.

According to another embodiment of the present invention there is provided a tuning arrangement for tuning the operational frequency bands of at least two antennas, comprising: a coupling element for electromagnetically coupling to a first antenna element and a second antenna element; and a switching mechanism, connected to the coupling element, for switching between a first electrical configuration and a second electrical configuration, wherein when the switching mechanism is in the first electrical configuration, the coupling element has a first impedance and when the switching mechanism is in the second electrical configuration, the coupling element has a second impedance.

According to a further embodiment of the invention there is provided a module comprising an antenna arrangement as described in the preceding paragraphs.

According to another embodiment of the invention there is provided a module comprising a tuning arrangement as described in the preceding paragraphs.

According to a further embodiment of the invention there is provided a portable electronic device comprising an antenna arrangement as described in the preceding paragraphs.

According to another embodiment there is provided a portable electronic device comprising a tuning arrangement as described in the preceding paragraphs.

BRIEF DESCRIPTION OF THE DRAWINGS

For a better understanding of the present invention reference will now be made by way of example only to the accompanying drawings in which.

DETAILED DESCRIPTION OF EMBODIMENTS OF THE INVENTION

Figure 1:
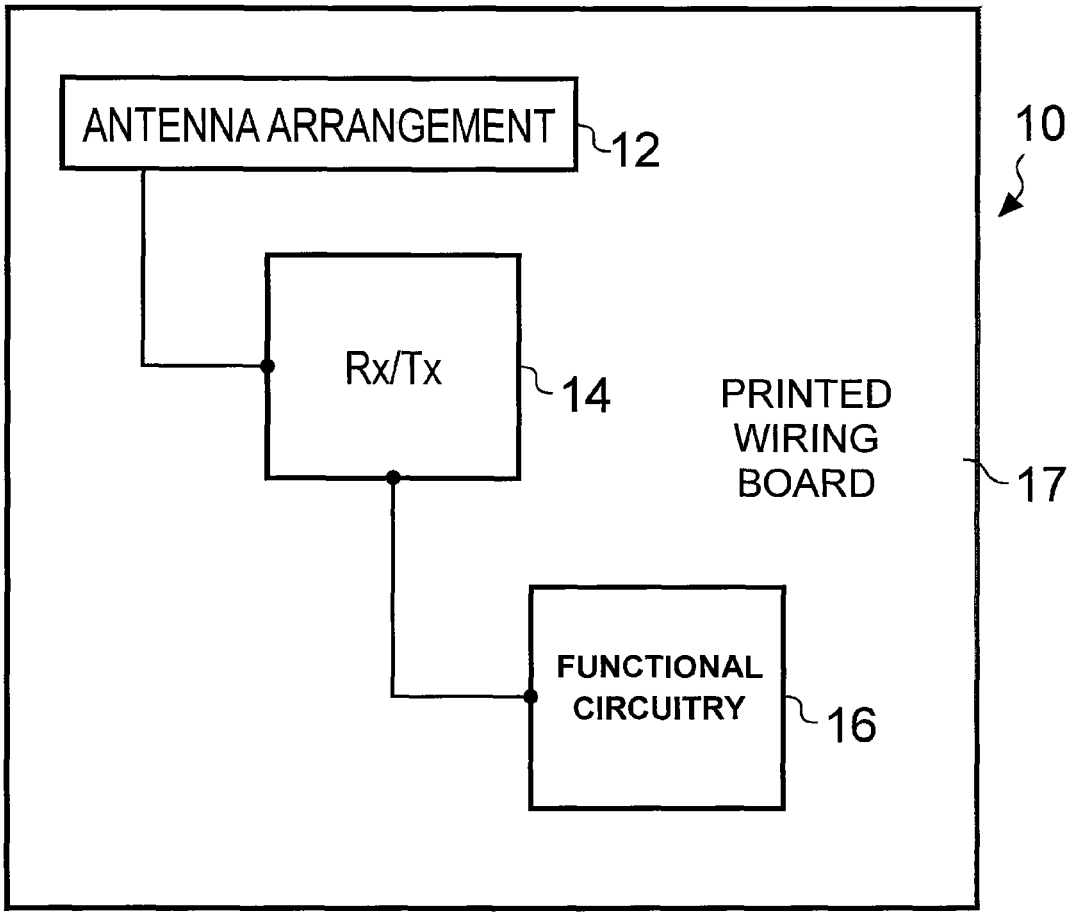
FIG. 1 illustrates schematic diagram of a radio transceiver device comprising an antenna arrangement.

The figures illustrate an antenna arrangement 12 comprising: a first antenna element 28; a second antenna element 30; a coupling element 20,32 for electromagnetically coupling to the first antenna element 28 and the second antenna element 30; and a switching mechanism 22, connected to the coupling element 20,32, for switching between a first electrical configuration and a second electrical configuration, wherein when the switching mechanism 22 is in the first electrical configuration, the coupling element 20,32 has a first impedance and when the switching mechanism 22 is in the second electrical configuration, the coupling element 20,32 has a second impedance.

In more detail, FIG. 1 illustrates a schematic diagram of a radio transceiver device 10 such as a mobile cellular telephone, laptop computer, other radio communication device or module for such devices. The radio transceiver device 10 comprises an antenna arrangement 12, radio transceiver circuitry 14 connected to the antenna arrangement 12 and functional circuitry 16 connected to the radio transceiver circuitry 14. In the embodiment where the radio transceiver device 10 is a mobile cellular telephone, the functional circuitry 16 includes a processor, a memory and input/output devices such as a microphone, a loudspeaker and a display. Typically the electronic components that provide the radio transceiver circuitry 14 and functional circuitry 16 are interconnected via a printed wiring board (PWB) 17. The PWB 17 may be used as a ground plane for the antenna arrangement 12.

Figure 2:
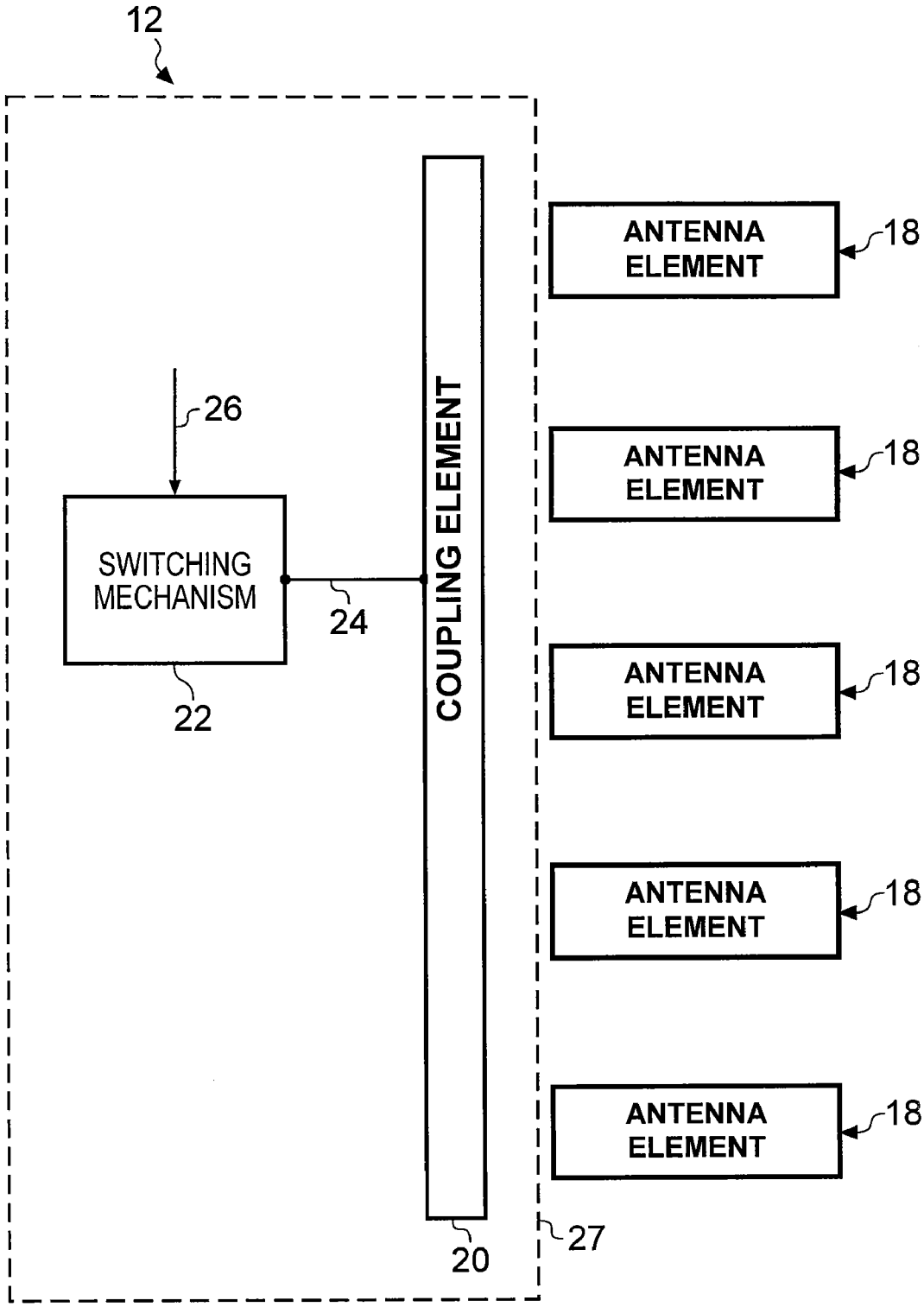
FIG. 2 illustrates a schematic diagram of an antenna arrangement according to a first embodiment of the present invention.

FIG. 2 illustrates a highly schematic diagram of an antenna arrangement 12 according to a first embodiment of the present invention. The antenna arrangement 12 includes a plurality of antenna elements 18, a coupling element 20 and a switching mechanism 22. The coupling element 20 is electrically connected to the switching mechanism 22 via an electrical connector 24 and is arranged to electromagnetically couple with two or more of the plurality of antenna elements 18.

Each antenna element of the plurality of antenna elements 18 is connected to a feed (not illustrated in this figure) via a feed point (not illustrated in this figure) and may be connected to the ground plane 17 (see FIG. 1) via a ground point (not illustrated in this figure). Each antenna element of the plurality of antenna elements 18 is positioned above the ground plane at a predetermined height and the plurality of antenna elements 18 may be any combination of planar inverted F antennas (PIFA's), Loop antennas, helix antennas, monopole antennas and planar inverted L antennas (PILA's). The plurality of antenna elements 18 are electrically connected to the radio transceiver circuitry 14 and are arranged to transmit electromagnetic waves to, and/or receive electromagnetic waves from, a further radio transceiver device.

As mentioned above, the coupling element 20 is arranged to electromagnetically couple with two or more of the plurality of antennas 18. The coupling element 20 may be a single element or it may include a plurality of elements all connected to the switching mechanism 22. The coupling element 20 comprises any conductive material and may comprise, in one embodiment, copper. The positioning and dimensions of the coupling element 20 are dependent upon the positioning of the plurality of antenna elements 18 and the desired electromagnetic coupling therebetween.

The switching mechanism 22 is operable in at least two electrical configurations and the selection of an electrical configuration is, in this embodiment, controlled by a processor of the functional circuitry 16 via a signal 26. In each electrical configuration of the switching mechanism 22, the interface between the switching mechanism 22 and the coupling element 20 is substantially reflective, i.e. the modulus of the coefficient of reflection at the interface is substantially equal to 1. However, the phase of the coefficient of reflection at the interface may vary for each electrical configuration from +1, representing an open circuit (a substantially infinite impedance), to −1, representing a short circuit (approximately zero impedance).

In one embodiment, when the switching mechanism is in a first electrical configuration, the phase of the coefficient of reflection at the interface is substantially equal to +1 (the coupling element 20 is effectively connected to an open circuit which has a substantially infinite impedance). Consequently, the electromagnetic coupling between the antenna elements 18 and the coupling element 20 is weak or nonexistent and the operational frequency bands of the antenna elements are relatively unaffected, i.e. when the switching mechanism 22 is in the first electrical configuration, the antenna elements 18 are operable in a first set of operational frequency bands.

When the switching mechanism 22 is in a second electrical configuration, the phase of the coefficient of reflection at the interface is substantially equal to −1 (the coupling element 20 is effectively connected to a short circuit which has a substantially zero impedance). Consequently, the electromagnetic coupling between the antenna elements 18 and the coupling element 20 is maximised and the operational frequency bands of the antenna elements 18 are shifted downwards in frequency, i.e. when the switching mechanism 22 is in the second electrical configuration, the antenna elements 18 are operable in a second set of operational frequency bands (the second set of operational frequency bands being different to the first set of operational frequency bands).

The first and second set of operational frequency bands may include any of the following operational frequency bands: US-GSM 850 (824-894 MHz), WCDMA 850, EGSM 900 (880-960 MHz), PCN/DCS1800 (1710-1880 MHz), GSM 1800, PCS1900 (1850-1990 MHz), US-WCDMA1900 (1850-1990), GSM 1900, WCDMA21000 band (Tx: 1920-1980, Rx: 2110-2170) and WLAN\BLUETOOTH (2400 MHz).

The coupling element 20 and the switching mechanism 22 may be collectively referred to as a tuning arrangement 27 and they provide an advantage in that they enable each antenna element in a plurality of antenna elements 18 to operate in two or more different operational frequency bands. Since a single switching mechanism 22 is used to tune the plurality of antenna elements 20, space may be saved within the radio transceiver device 10 which may lead to a reduction in the dimensions of the radio transceiver device 10. Further-more, a single switching mechanism 22 may reduce the number of components within the radio transceiver device 10 and therefore reduce the cost and increase the reliability of the radio transceiver device 10.

Figure 3:
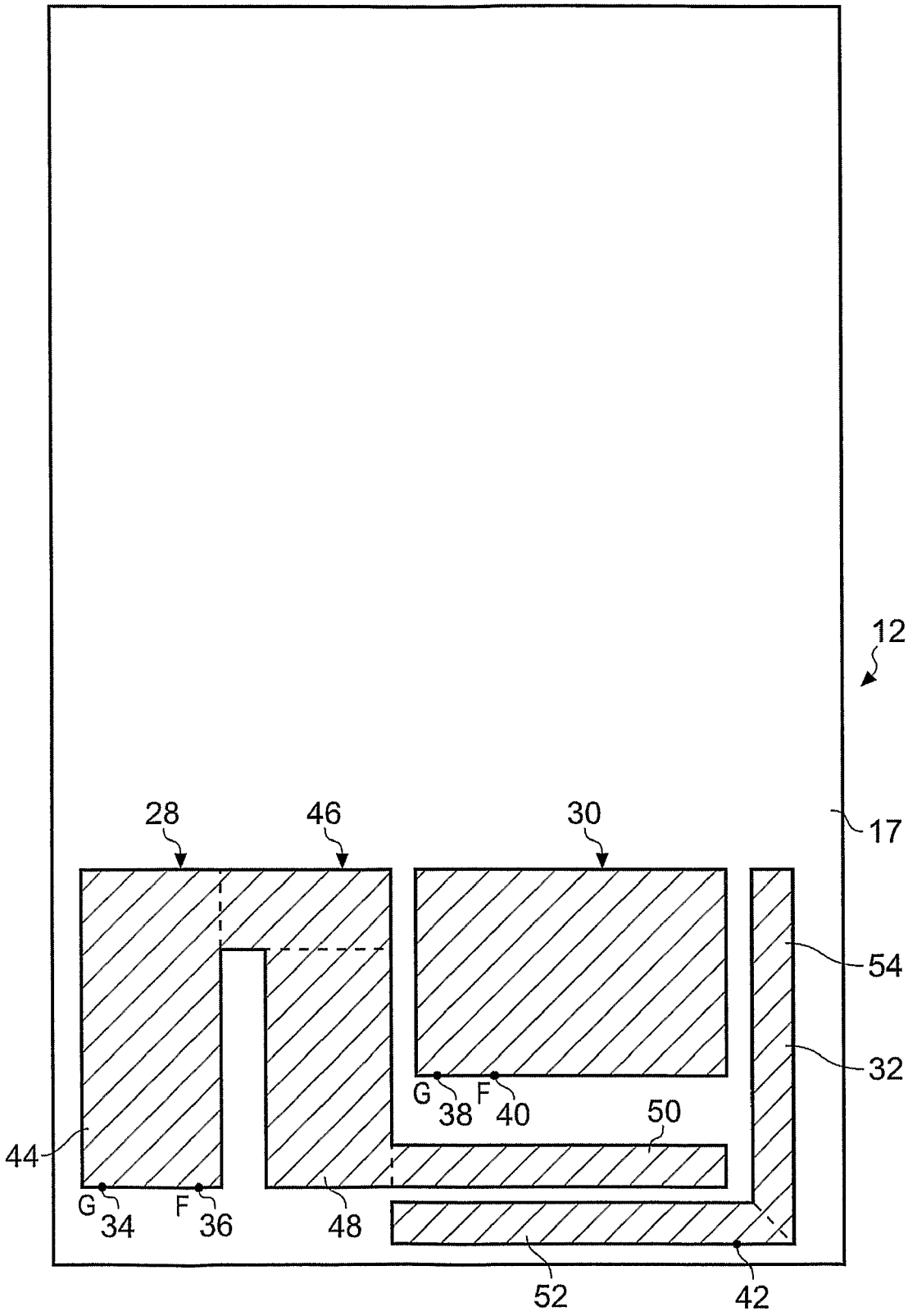
FIG. 3 illustrates a diagrammatic top down view of an antenna arrangement according to a second embodiment of the present invention.
Figure 4:
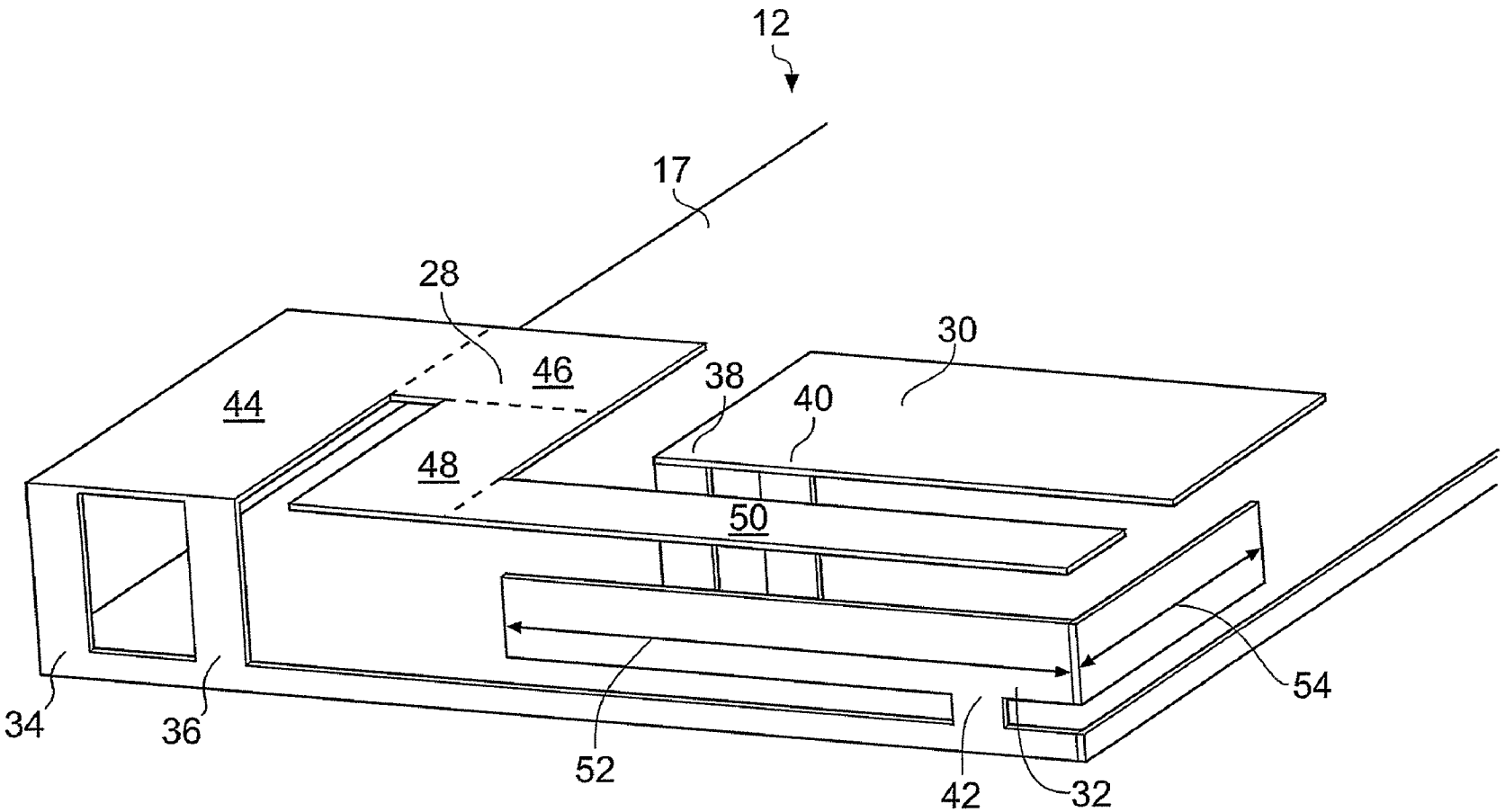
FIG. 4 illustrates a diagrammatic perspective view of the antenna arrangement illustrated in FIG. 3.
Figure 5:
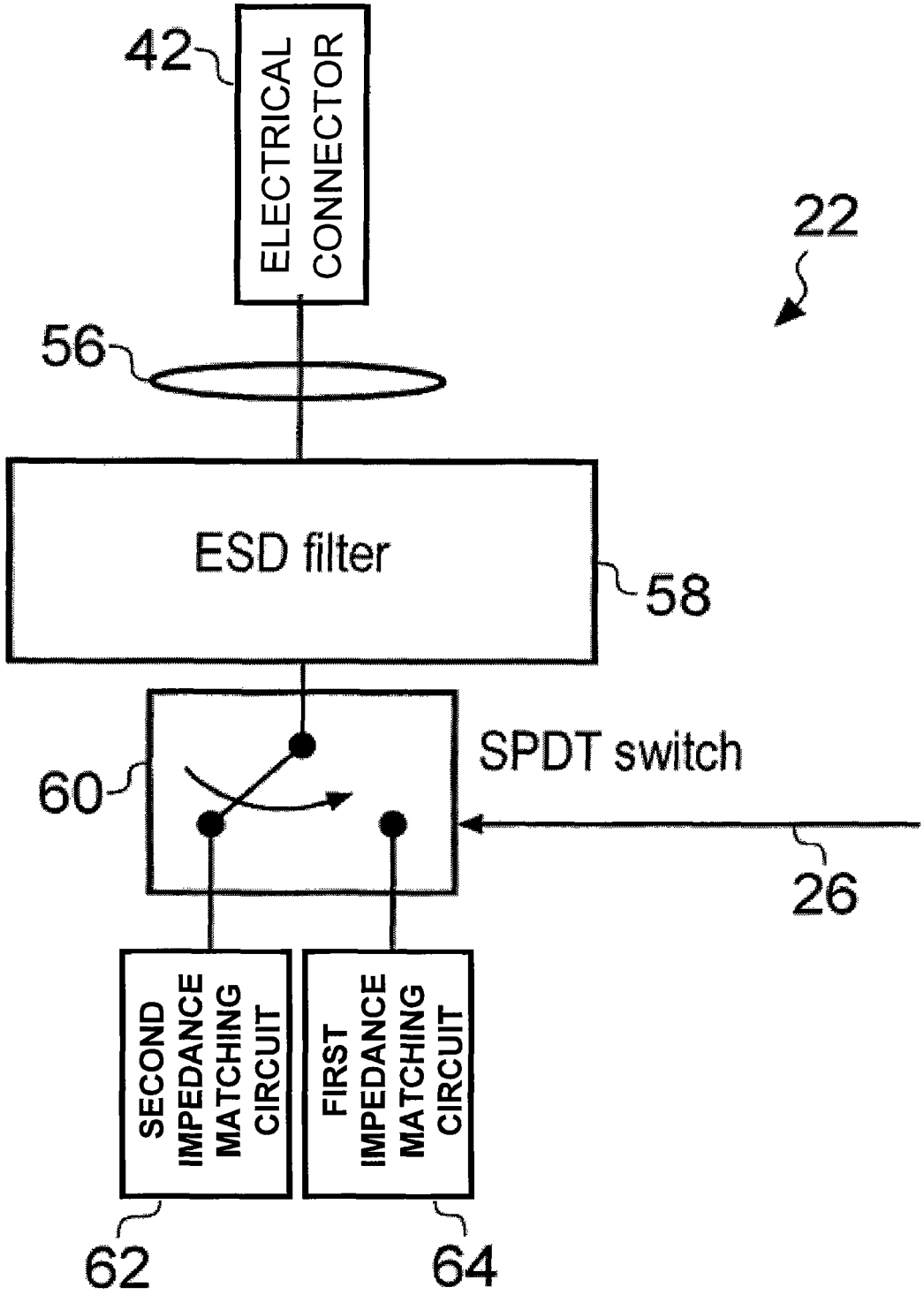
FIG. 5 illustrates a schematic diagram of a switching mechanism according to one embodiment of the present invention.

FIGS. 3 to 5 illustrate a more detailed embodiment of an antenna arrangement according to the present invention. FIG. 3 illustrates a diagrammatic top down view of an antenna arrangement 12 according to a second embodiment of the present invention. The antenna arrangement 12 includes a first antenna element 28, a second antenna element 30 and a coupling element 32.

The first antenna element 28 is a PIFA and is connected to the ground plane 17 via a ground point 34 and to a feed (not illustrated) via a feed point 36. The second antenna element 30 is a PIFA and is connected to the ground plane 17 via a ground point 38 and to a feed (not illustrated) via a feed point 40. The coupling element 32 is connected to a switching mechanism (not illustrated) via a connector 42.

In order to aid the description of the structure of the first antenna element 28, it may be viewed as being divided into a first portion 44, a second portion 46, a third portion 48 and a fourth portion 50. It should be appreciated that the first antenna element 28 is not physically divided into these portions and that they are merely provided to aid in the description of the first antenna element 28.

The first portion 44 extends upwards from the ground point 34 and the feed point 36 and has a rectangular shape whereby its length is greater than its width. The second portion 46 extends perpendicularly from the top of the right hand side of the first portion 44 and has a rectangular shape whereby its width is greater than its length. The third portion 48 extends perpendicularly from the right hand side of the bottom of the second portion 46 and has a rectangular shape whereby its length is greater than its width. The fourth portion 50 extends perpendicularly from the bottom of the right hand side of the third portion 48 and has a rectangular shape whereby its width is greater than its length.

The second antenna element 30 has a rectangular shape and the ground point 38 and the feed point 40 are positioned at the bottom left hand corner of the antenna 30. The second antenna element 30 is positioned adjacent and above the fourth portion 50 of the second antenna element 28. The right hand side of the second antenna element 30 is substantially in line with the right hand side of the fourth portion 50 of the first antenna element 28.

The coupling element 32 includes a first portion 52 which extends horizontally from the connector 42 and a second portion 54 which extends vertically from the connector 42. The first portion 52 of the coupling element 32 is positioned in proximity to and adjacent the fourth portion 50 of the first antenna element 28 and the second portion 54 of the coupling element 32 is positioned in proximity to and adjacent the right hand side of the second antenna element 30. The first portion 52 of the coupling element 32 capacitively couples with the first antenna element 28 and the second portion 54 of the coupling element 32 capacitively couples with the second antenna element 30.

In order to aid the visualisation of the antenna arrangement 12, FIG. 4 illustrates a perspective diagram of the antenna arrangement 12 illustrated in FIG. 3. Where the features illustrated in FIG. 4 are the same or similar to those illustrated in FIG. 3, the same reference numerals have been used.

FIG. 5 illustrates a schematic diagram of a switching mechanism 22 according to one embodiment of the present invention. The switching mechanism 22 includes an interface 56 which is connected to an ESD filter 58, which is in turn connected to a switch 60. The switch 60 may be electrically connected to a first impedance matching circuit 62 or a second impedance matching circuit 64. The switching mechanism 22 is connected to the coupling element 32 illustrated in FIGS. 3 & 4 via the electrical connector 42 at the interface 56.

The ESD filter 58 is a well known electronic component and will consequently not be described in detail here. Briefly, the ESD filter 58 is for reducing electro-static discharge noise from the coupling element 20 and for filtering harmonics produced by the switch 60.

In this embodiment, the switch 60 is a single pole, double throw (SPDT) switch but in other embodiments may be any multi-way switch depending on the number of impedance matching circuits. SPDT switches and multi-way switches are well known within the art and will consequently not be discussed in detail here. The SPDT switch 60 may be switched between a first electrical configuration (illustrated in FIG. 5) in which the first impedance matching circuit 62 is connected to the coupling element 32, and a second electrical configuration in which the second impedance matching circuit 64 is connected to the coupling element 32.

Figure 6B:
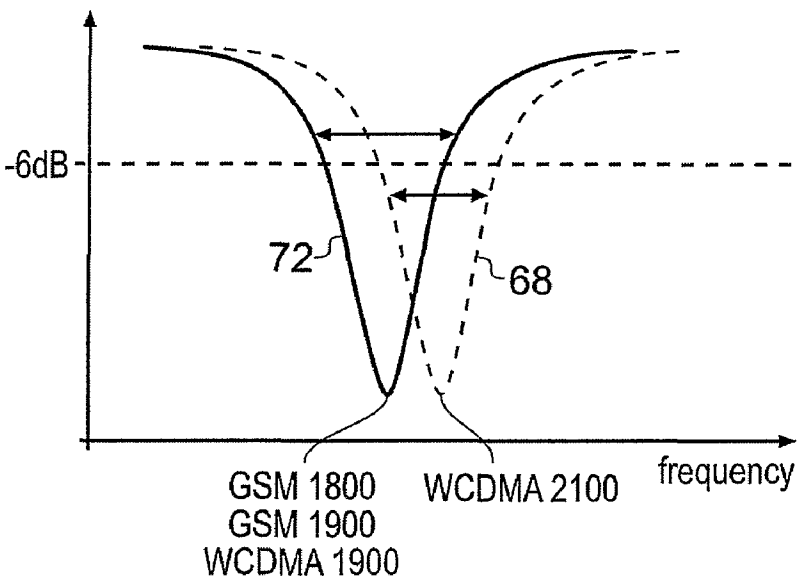
FIG. 6B illustrates a graph of the second and fourth operational frequency bands of the second antenna element 30 illustrated in FIGS. 3 & 4.
Figure 6A:
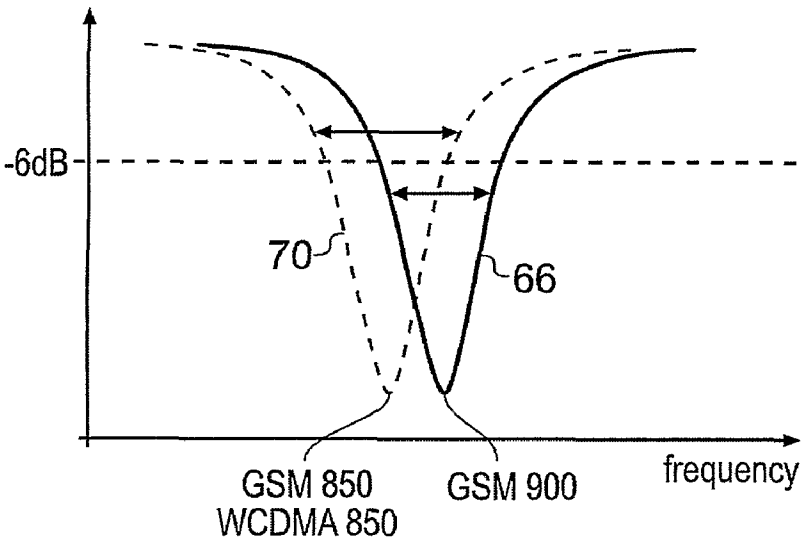
FIG. 6A illustrates a graph of the first and third operational frequency bands of the first antenna element 28 illustrated in FIGS. 3 & 4.

The first impedance matching circuit 62 has a large impedance relative to the coupling element 32. Consequently, when the switch 60 is in the first electrical configuration, the coefficient of reflection at the interface 56 is substantially equal to +1. The coupling element 32 is effectively connected to an open circuit and does not substantially capacitively couple with the first antenna element 28 or the second antenna element 30. In this configuration, the first antenna element 28 operates in a first operational frequency band 66 (GSM 900, see FIG. 6A) and the second antenna element 30 operates in a second operational frequency band 68 (WCDMA 2100, see FIG. 6B).

The second impedance matching circuit 64 has a small impedance relative to the coupling element 32. Consequently, when the switch 60 is in the second electrical configuration, the coefficient of reflection at the interface 56 is substantially equal to −1. The coupling element 32 is effectively connected to a short circuit and substantially capacitively couples with the first antenna element 28 and the second antenna element 30. In detail, the first portion 52 of the coupling element 32 capacitively couples with the first antenna element 28 and the second portion 54 of the coupling element 32 capacitively couples with the second antenna element 30. The capacitive coupling shifts the operational frequency bands of the first antenna element 28 and the second antenna element 30 down in frequency. Consequently, the first antenna element 28 operates in a third operational frequency band 70 (GSM 850/WCDMA 850, see FIG. 6A) and the second antenna element 30 operates in a fourth operational frequency band 72 (GSM 1800/GSM 1900/WCDMA 1900, see FIG. 6B).

In this embodiment, the first impedance matching circuit 62 and the second impedance matching circuit 64 each comprise a transmission line (not illustrated). A transmission line is a strip of metallic material (e.g. copper) which has an impedance which is dependent upon the material of the transmission line, the length of the transmission line and the width of the transmission line. By varying these properties of the transmission lines, it is possible to obtain a desired impedance for the first impedance matching circuit 62 and for the second impedance matching circuit 64.

Figure 7:
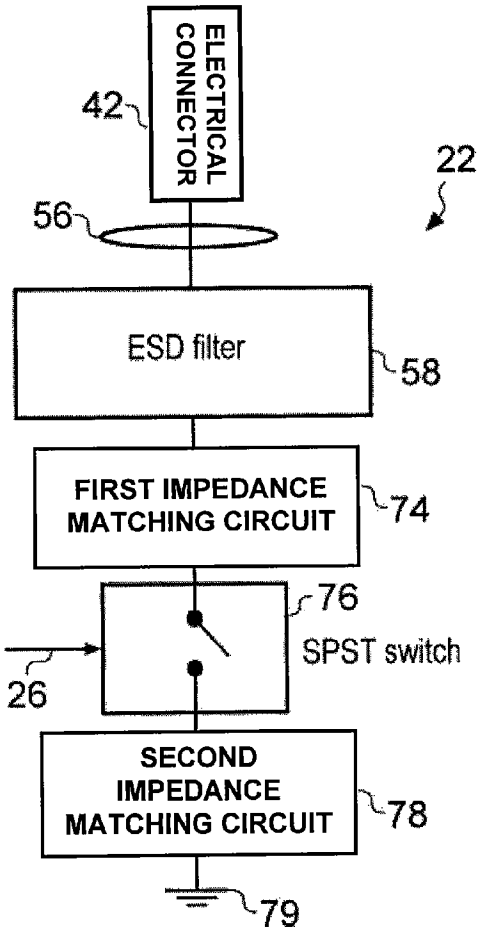
FIG. 7 illustrates a schematic diagram of a switching mechanism according to another embodiment of the present invention.

FIG. 7 illustrates a schematic diagram of a switching mechanism 22 according to another embodiment of the present invention. The switching mechanism 22 illustrated in FIG. 7 is similar to the switching mechanism 22 illustrated in FIG. 5 and where they have similar features, the same reference numerals are used. In this embodiment, the ESD filter 58 is connected to a first impedance matching circuit 74, which is in turn connected to single pole, single throw (SPST) switch 76. The SPST switch 76 is connectable to a second impedance matching circuit 78.

The SPST switch 76 may be switched between a first electrical configuration (illustrated in FIG. 7) in which the switch 76 is open and the coupling element 32 is connected to the first impedance matching circuit 74, and a second electrical configuration in which the switch 76 is closed and the coupling element 32 is connected to the first impedance matching circuit 74 and the second impedance matching circuit 78 (and hence to ground 79).

When the switch 76 is in the first electrical configuration, the first impedance matching circuit 74 has a large impedance relative to the coupling element 32 (since the first impedance matching circuit 74 is not connected to ground). Consequently, when the switch 76 is in the first electrical configuration, the coefficient of reflection at the interface 56 is substantially equal to +1. The coupling element 32 is effectively connected to an open circuit and does not substantially capacitively couple with the first antenna element 28 or the second antenna element 30. In this configuration, the first antenna element 28 operates in a first operational frequency band 66 (GSM 900, see FIG. 6A) and the second antenna element 30 operates in a second operational frequency band 68 (WCDMA, see FIG. 6B).

When the switch 76 is in the second electrical configuration, the first impedance matching circuit 74 and the second impedance matching circuit 78 have a small combined impedance relative to the coupling element 32 (since the second impedance matching circuit 78 is connected to ground 79). Consequently, when the switch 76 is in the second electrical configuration, the coefficient of reflection at the interface 56 is substantially equal to −1. The coupling element is effectively coupled to a short circuit and substantially capacitively couples with the first antenna element 28 and the second antenna element 30 as described above. Consequently, the first antenna element 28 operates in a third operational frequency band 70 (GSM 850/WCDMA 850, see FIG. 6A) and the second antenna element 30 operates in a fourth operational frequency band 72 (GSM 1800/GSM 1900/WCDMA 1900, see FIG. 6B).

The first impedance matching circuit 74 and the second impedance matching circuit 78 may each comprise a transmission line as described above.

Figure 8:
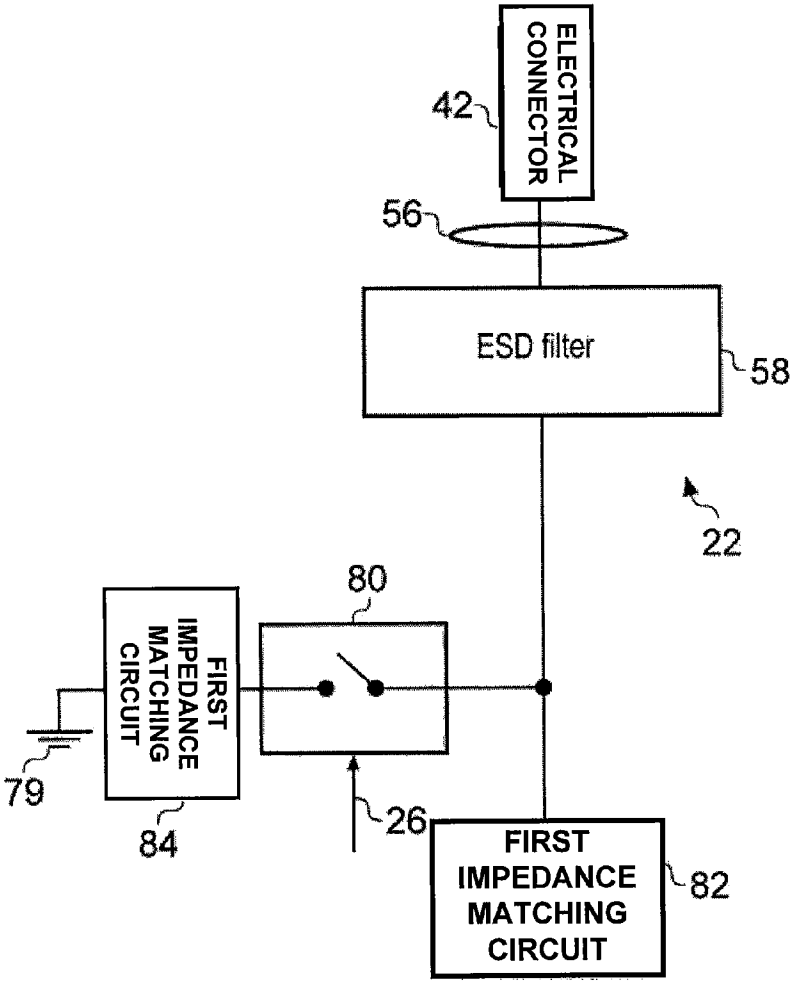
FIG. 8 illustrates a schematic diagram of a switching mechanism according to a further embodiment of the present invention.

FIG. 8 illustrates a schematic diagram of a switching mechanism 22 according to further embodiment of the present invention. The switching mechanism 22 illustrated in FIG. 8 is similar to the switching mechanisms 22 illustrated in FIGS. 5 & 7 and where they have similar features, the same reference numerals are used. In this embodiment, the ESD filter 58 is connected to a single pole, single throw (SPST) switch 80 and to a first impedance matching circuit 82. The SPST switch 80 is connectable to a second impedance matching circuit 84.

The SPST switch 80 may be switched between a first electrical configuration (illustrated in FIG. 8) in which the switch 80 is open and the coupling element 32 is connected to the first impedance matching circuit 82, and a second electrical configuration in which the switch 80 is closed and the coupling element 32 is connected to the second impedance matching circuit 84 (and hence to ground 79).

The first impedance matching circuit 82 has a large impedance relative to the coupling element 32. Consequently, when the switch 80 is in the first electrical configuration, the coefficient of reflection at the interface 56 is substantially equal to +1. The coupling element 32 is effectively connected to an open circuit and does not substantially capacitively couple with the first antenna element 28 or the second antenna element 30. In this configuration, the first antenna element 28 operates in a first operational frequency band 66 (GSM 900, see FIG. 6A) and the second antenna element 30 operates in a second operational frequency band 68 (WCDMA, see FIG. 6B).

The second impedance matching circuit 84 has a small impedance relative to the coupling element 32 (since the second impedance matching circuit 84 is connected to ground 79). Consequently, when the switch 80 is in the second electrical configuration, the coefficient of reflection at the interface 56 is substantially equal to −1. The coupling element 32 is effectively coupled to a short circuit and substantially capacitively couples with the first antenna element 28 and the second antenna element 30 as described above. Consequently, the first antenna element 28 operates in a third operational frequency band 70 (GSM 850/WCDMA 850, see FIG. 6A) and the second antenna element 30 operates in a fourth operational frequency band 72 (GSM 1800/GSM 1900/WCDMA 1900, see FIG. 6B).

The first impedance matching circuit 82 and the second impedance matching circuit 84 may each comprise a transmission line as described above.

The first impedance matching circuits 74 and 82 illustrated in FIGS. 7 & 8 respectively, are provided so that when the switches 76 & 80 are in an open configuration (the first electrical configuration) they correct the phase shift introduced by the switches 76 & 80 so that the coupling element 32 is effectively connected to an open circuit.

Although embodiments of the present invention have been described in the preceding paragraphs with reference to various examples, it should be appreciated that modifications to the examples given can be made without departing from the scope of the invention as claimed. For example, at least a portion of one or more of the antenna elements 18, 28, 30 may extend beyond the periphery of the ground plane 17.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. The antenna arrangement comprising:

a first antenna element;

a second antenna element;

a coupling element comprising a first portion and a second portion, the first portion being configured to electromagnetically couple with the first antenna element and the second portion being configured to electromagnetically couple with the second antenna element; and a switching mechanism, connected to the coupling element via a connector, configured to switch between a first electrical configuration and a second electrical configuration, wherein when the switching mechanism is in the first electrical configuration, the coupling element has a first impedance and when the switching mechanism is in the second electrical configuration, the coupling element has a second impedance; and wherein the first portion of the coupling element extends from the connector in a first direction and the second portion of the coupling element extends from the connector in a second different direction.

2. The antenna arrangement as claimed in claim 1, wherein when the switching mechanism is in the first electrical configuration, the first antenna element operates in a first operational frequency band and the second antenna element operates in a second operational frequency band.

3. The antenna arrangement as claimed in claim 1, wherein when the switching mechanism is in the second electrical configuration, the first antenna element operates in a third operational frequency band and the second antenna element operates in a fourth operational frequency band.

4. The antenna arrangement as claimed in claim 1, wherein the switching mechanism comprises a first impedance matching circuit, a second impedance matching circuit and a switch configured to connect the coupling element to the first impedance matching circuit or the second impedance matching circuit.

5. The antenna arrangement as claimed in claim 4, wherein the switching mechanism is in the first electrical configuration when the switch connects the first impedance matching circuit to the coupling element.

6. The antenna arrangement as claimed in claim 4, wherein the switching mechanism is in the second electrical configuration when the switch connects the second impedance matching circuit to the coupling element.

7. The antenna arrangement as claimed in claim 1, comprising a plurality of antenna elements, wherein the coupling element is configured to electromagnetically couple to each of the plurality of antennas.

8. The antenna arrangement as claimed in claim 7, wherein when the switching mechanism is in the first electrical configuration, the plurality of antenna elements operate in a first set of operational frequency bands.

9. The antenna arrangement as claimed in claim 7, wherein when the switching mechanism is in the second electrical configuration, the plurality of antenna elements operate in a second set of operational frequency bands.

10. The antenna arrangement as claimed in claim 1, wherein each antenna element is connected to a feed via a feed point and to a ground plane via a ground point.

11. A module comprising the antenna arrangement as claimed in claim 1.

12. A portable electronic device comprising the antenna arrangement as claimed in claim 1.

13. A tuning arrangement for tuning the operational frequency bands of at least two antennas, comprising:

a coupling element comprising a first portion and a second portion, the first portion being configured to electromagnetically couple with a first antenna element and the second portion being configured to electromagnetically couple with a second antenna element; and a switching mechanism, connected to the coupling element via a connector, configured to switch between a first electrical configuration and a second electrical configuration, wherein when the switching mechanism is in the first electrical configuration, the coupling element has a first impedance and when the switching mechanism is in the second electrical configuration, the coupling element has a second impedance; and wherein the first portion of the coupling element extends from the connector in a first direction and the second portion of the coupling element extends from the connector in a second different direction.

14. A module comprising the tuning arrangement as claimed in claim 13.

15. A portable electronic device comprising the tuning arrangement as claimed in claim 13.

16. An antenna arrangement comprising:

a first antenna element;

a second antenna element;

coupling means comprising a first portion and a second portion, the first portion for electromagnetically coupling with the first antenna element and second portion for electromagnetically coupling with the second antenna element; and means, connected to the coupling means via a connector means, for switching between a first electrical configuration and a second electrical configuration, wherein when said means for switching is in the first electrical configuration, the means for electromagnetically coupling has a first impedance and when said means for switching is in the second electrical configuration, the means for electromagnetically coupling has a second impedance; and wherein the first portion of the coupling means extends from the connector means in a first direction and the second portion of the coupling means extends from the connector means in a second different direction.

* * * * *